United States Patent [19]

Weiss

[11] 4,443,981

[45] Apr. 24, 1984

[54] CONCRETE FORM SYSTEM

[76] Inventor: David Weiss, P.O. Box 27, Armstrong, B.C., Canada

[21] Appl. No.: 299,085

[22] Filed: Sep. 3, 1981

[51] Int. Cl.[3] ..... E02D 5/74

[52] U.S. Cl. ..... 52/155; 52/169.1; 52/371; 404/8; 404/68; 249/3

[58] Field of Search ..... 52/169.1, 371, 293, 52/169.12, 155; 404/8, 68, 48, 47, 50; 249/3, 4, 249/6

[56] References Cited

U.S. PATENT DOCUMENTS

| | | | |
|---|---|---|---|
| 1,635,093 | 7/1927 | Mc Pherson | 52/528 |
| 2,356,309 | 8/1944 | Garbe | 52/450 |
| 3,057,269 | 10/1962 | Artgalas | 404/50 |
| 3,256,655 | 6/1966 | Teeter | 52/155 |
| 3,596,420 | 8/1971 | Packer | 52/169.12 |
| 4,012,159 | 3/1977 | Berry | 404/68 |
| 4,202,145 | 5/1980 | Coulter et al. | 52/169.1 |

*Primary Examiner*—Henry E. Raduazo

*Attorney, Agent, or Firm*—Kokjer, Kircher, Bradley, Wharton, Bowman & Johnson

[57] ABSTRACT

This invention is directed to a system for pouring concrete and thereby forming concrete floors, sidewalks and the like, wherein the forms used to retain the concrete in place remain as part of the permanent installation. The system is constructed basically of longitudinal rails, stakes and clips which fit snugly and securely together to form concrete retaining forms.

10 Claims, 11 Drawing Figures

CONCRETE FORM SYSTEM

FIELD OF THE INVENTION

This invention is directed to a system for forming concrete floors, sidewalks and the like, and in particular, is directed to a system for forming concrete floors, sidewalks and the like, wherein the forms used to retain the concrete in place remain as part of the permanent installation.

BACKGROUND OF THE INVENTION

A number of systems are known for pouring concrete in place to form floors, sidewalks, and the like. Some of the systems use forms to hold the concrete in place while it is poured, during setting, and then remain in place as part of the permanent installation. These systems, at least the ones that are known to the inventor, appear to suffer from a number of serious drawbacks which detract from their use efficency and hence popularity.

One particular system available in the United States is manufactured and sold by Leav-er-ite Manufacturing Company Inc., Sheridan, Wy., U.S.A. That system involves the use of forms of light gauge metal, such as steel, which is preformed so that it can be installed in place without modification at the job site. The system consists of steel concrete retaining sidewalls which have a plurality of spaced perforations or slots along the length of the sidewall. These sidewalls are laid end to end on either side of the proposed sidewalk and are held in place by steel cross-members. Clips with projections that fit through the slots in the sidewall are used to hold the cross-members in place relative to the side walls. The cross-members are not as deep as the sidewalls, and hence, when the concrete is poured, the cross-members are buried by concrete and obscured from view. The cross-members remain in place as part of the permanent concrete installation. The sidewalls and sidewall clips are held in place by sheet metal stakes which are driven into the ground at appropriate locations along the length of the sidewall. Sheet metal corner pieces are also available to enable the sidewalls to be used in forming inside and outside corners.

One serious difficultly with the Leav-er-ite system is that the slots in the sidewalls are very narrow in order to provide a snug relatively wiggle-free fit with the sidewall clips that are attached to the cross-members. It has been found in practice on the construction site that the slot and clip projection tolerances provided are too fine to enable rough and ready installation. Considerable trial and error tinkering must be done in order to fit the pieces together, particularly on uneven terrain. Simple errors of variations in position of one-sixteenth of an inch prevent the clips fitting through even the closest of the slots in the sidewalls. When this happens, the stakes holding the sidewalls to the ground must be pulled and driven in again at a slightly different location, with no assurance that the second position will be any better than the first position. The system is therefore inherently labour intensive, notwithstanding that the system is supposed to minimize labour input.

SUMMARY OF THE INVENTION

I have invented a concrete form retaining system which is inexpensive to use, easy to install, and minimizes expensive labour input.

The permanent, in-place, concrete retaining form comprises in combination (a) a longitudinal rail having along the length thereof, vertically disposed above one another, at least two alternating grooves and ridges, and at the to region thereof a top ridge which has an overhang which at the lower edge thereof extends below the elevation where the top ridge meets the body of the rail, and at the top edge thereof has a lip which extends downwardly; (b) a stake in the shape of a U-shaped channel, the top portion of the stake fitting under the top lip of the rail, the lower portion of the stake having therein a hook means for securing the bottom region of the rail to the stake; and, (c) a clip which is formed to fit snugly over the end of the rail.

The longitudinal rail of the concrete form may comprise in descending relationship to one another: (a) a top ridge extending along the length of the rail which has at the top thereof a lip which projects downwardly and at the bottom thereof an overhang portion which extends below the elevation where the top ridge joins with the base of the rail, (b) a groove extending along the length of the rail, (c) a ridge extending along the length of the rail; and (d) a base portion extending along the length of the rail.

The ridge (c) may be shaped cross-sectionally to have at the bottom thereof an overhang portion which extends below the elevation where the top ridge joins with the base of the rail.

The end of the rail is designed so that it can be secured in end to end relationship with a second rail by means of a clip which is shaped to fit onto the rail and at its top hooks onto the overhang of ridge (a) and at its bottom hooks under base (d).

DRAWINGS

DETAILED DESCRIPTION OF AN EMBODIMENT OF THE INVENTION

Figure 1:
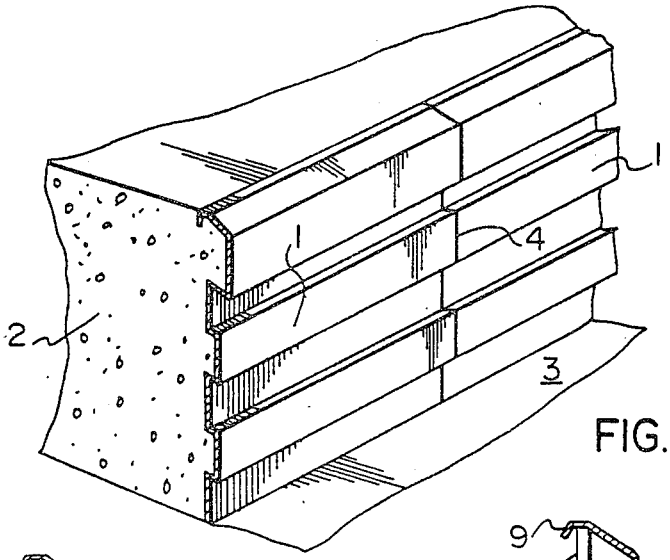
FIG. 1 represents a perspective view of a metal siderail with concrete poured on one side thereof, a section being cut away from the concrete and the sidewall to expose an edge of the sidewall and the concrete.

As can be seen in FIG. 1, two elongated rails 1 rest in place end to end along the ground 3 and provide a perpendicular retaining means for concrete 2 which is shown on the left side of the two rails 1. The concrete 2 is poured in place after the rail has been installed in place along the ground 3. FIG. 1 also shows a seam 4 that exists between two rails 1 when they are laid end to end. It can be see that when viewed from the exterior, only the seam 4 is visible. There is no visible evidence of the means that are for securing the two rails 1 together in end to end relationship or holding the rails to the ground 3.

Figure 2:
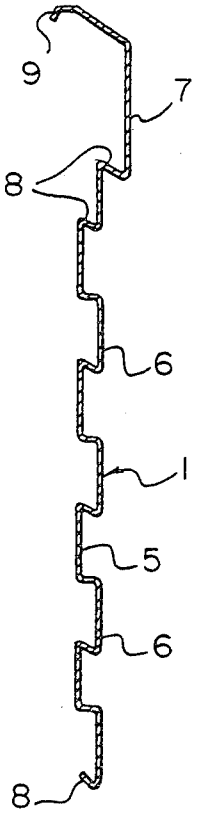
FIG. 2 represents a an elevation view of a siderail.

Referring to FIG. 2, whidh depicts an end elevation view of the rail 1, it can be seen that the rail 1 is formed (from a suitable material such as aluminium or galvanized steel) to have therein a number of grooves 5 that run lengthwise along the rail. These grooves 5 alternate with a number of ridges 6, which also run lengthwise along the rail 1. These grooves 5 and ridges 6 provide structural strength to the rail 1. A larger more pronounced top ridge 7 is formed at the top region of the rail 1. The top ridge 7 extends laterally a greater distance than any of the lower ridges 6. The bottom portions of the top ridge 7 and each underlying ridge 6 are formed to have an overhang 8 which extends downwardly to an elevation below the points where the top ridge 7 and the ridges 6 join the body portion of the rail 1. This enables the ridges 6 and 7 to grip the concrete that is poured in place behind the rail 1. The top region of the top ridge 7 is crimped or bent to form a lip 9, which extends downwardly to an elevation below the top most portion of the top ridge 7.

When the concrete is poured in place against the rail 1, (in this case, on the left side of the rail 1 as shown in FIG. 2) the concrete is tamped in place to completely fill the left side of the top ridge 7 and to flow into the respective overhangs 8. Overhangs 8, by design, provide a locking action on the concrete. Further, the lip 9 extends down into the finished concrete when the concrete surface has been smoothed flat, as shown in FIG. 1, thereby providing a second locking action. Thus, the rail 1, by means of the respective overhangs 8 and top lip 9, grips the poured-in-place concrete once it is set, and provides a unitary fit with the concrete. By burying the lip 9 in the concrete, the top region of the rail 1 is not inclined to be scuffed and bent away from the poured-in-place concrete.

Figure 3:
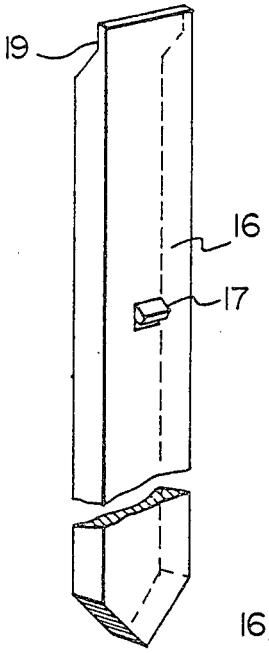
FIG. 3 represents a perspective view of a stake used to secure a siderail on the ground.

FIG. 3 illustrates a perspective view of a stake 16, which is used to hold the rail 1 securely on the ground. The stake 16 is formed to have a U-shaped channel cross-section and a point at the bottom. The stake is punched in an appropriate location along its length to form a downwardly and outwardly protruding hook 17. The top region of the stake 16 has a cut-away or flattened section 19, which fits under the lip 9 of rail 1.

Figure 4:
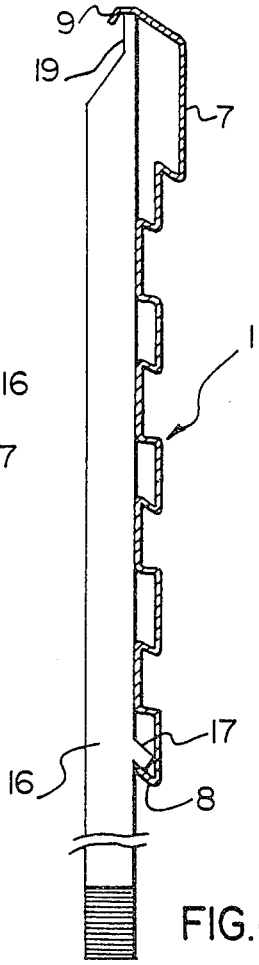
FIG. 4 represents an end elevation view of a stake interlocking with a siderail.

FIG. 4 illustrates by means of a side elevation view the manner in which stake 16 is secured to rail 1. The top section 19 of the stake 16 fits behind lip 9. The hook 17 hooks behind the lowest overhang 8.

Figure 5:
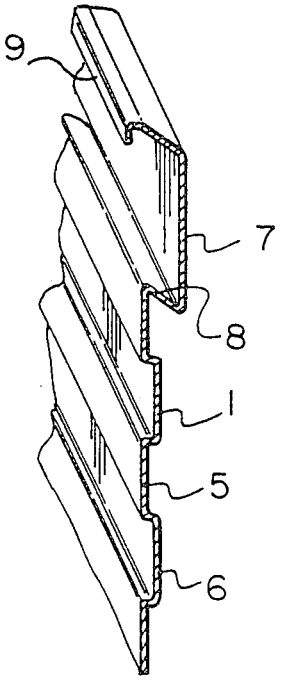
FIG. 5 represents a perspective view of a section of an alternative embodiment of siderail.

FIG. 5 illustrates an alternative design of rail 1. The rail 1 shown in FIG. 5 does not have overhangs 8 on the lower ridges 6 including the bottom ridge. This rail design is cheaper to manufacture but has less gripping action on the concrete.

The rails shown in FIGS. 2 and 5 are typically of about $3\frac{1}{2}''$ in height, thereby enabling a $3\frac{1}{2}''$ thick slab of concrete to be poured.

Figure 6:
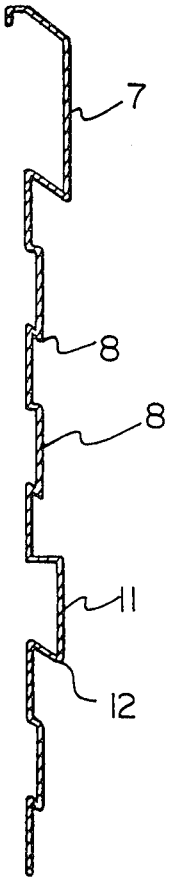
FIG. 6 represents an end elevation view of a siderail designed specifically for deep poured concrete.

FIG. 6 illustrates a deeper design rail 10. Deep rail 10 can be used in situations where thicker or deeper slabs of concrete must be formed. The deep rail 10 shown in FIG. 6 may be designed to be of any reasonable depth, but typically is about 7" in depth. Deep rail 10 is formed in the same general manner as rail 1 (shown in FIG. 2) except a mid-ridge 11 of deeper dimensions than ridge 7, is formed in the lower portion of the rail 10. Mid-ridge 11, similar to top ridge 7, has an overhang 12, which extends downwardly to an elevation below the point where the ridge meets with the main body of rail 1. Mid-ridge 11, by means of the overhang 12, provides a third major locking point (in addition to the top lip and overhang of the top ridge 7) and ensures that the mid regions of the rail 1 are securely fixed to the concrete. This, in addition to normal overhangs 8 at the bottom of each ridge 6, prevents the mid regions of the rail 1 from buckling or being pulled away from the concrete, once it has been poured in place and has been set.

Figure 7:
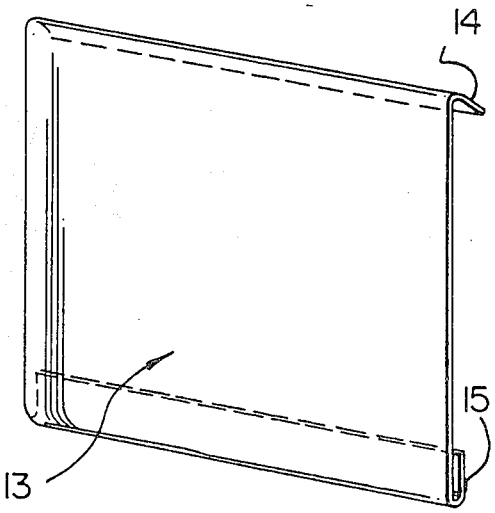
FIG. 7 represents a perspective view of a clip used to hold two siderails together in end to end relationship.

A specially designed clip 13 for holding the adjacent ends of adjacent rails 1 together is illustrated in FIG. 7. Clip 13 fits on the interior of the adjoining rails 1 and is not visible once the concrete has been poured in place against the inside surface of the clip 13. The clip 13 is formed to have a top catch 14 and a bottom catch 15. When two rails 1 have been laid in end to end relationship with one another on the ground, they are secured together in place by slipping bottom catch 15 over two bottom portions of the two adjoining rails 1 and then snapping top catch 14 over overhang 8 of the two adjoining rails 1. The manner in which the clip 13 is snapped in place over one design of rail 1 is illustrated in end elevation view in FIG. 8. In particular, it should be noted that clip 13 is formed so that bottom catch 15 fits snugly on the bottom region of the rail 1, and the top catch 14 provides a snug fit over overhang 8.

Figure 9:
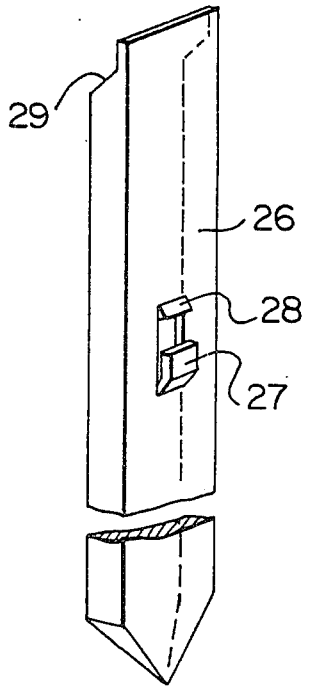
FIG. 9 represents a perspective view of a stake design used to hold the alternative design of siderail in place on the ground.

FIG. 9 illustrates an alternative design of stake 26 designed to fit with the alternative rail design illustrated in FIG. 5. The stake 26 has a downwardly and outwardly projecting hook 28 and below that an opposing upwardly and outwardly extending catch 27. Hook, 28 straps over overhang 8 of the rail and catch 27 fits behind the lower edge of the rail thereby securely fitting the rail to the stake 26. Top flattened portion 29 fits under the top ridge of the rail.

Figure 10:
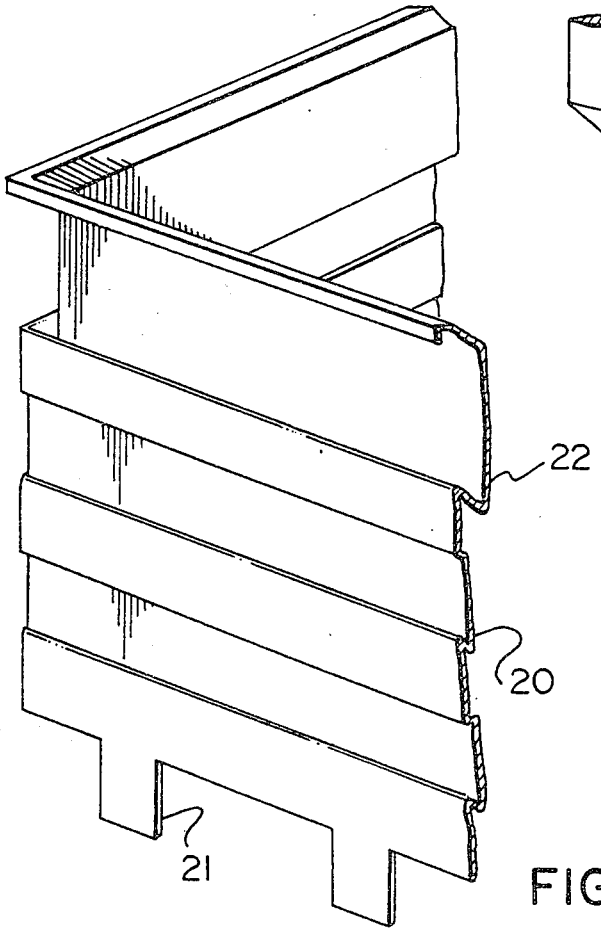
FIG. 10 represents a perspective view of a corner holder.

FIG. 10 illustrates one form of corner holder 20. A corner holder 20 of the design shown is used on an inside corner of a concrete installation. Corner holder 20 is formed to have generally the same end view shape as rail 1, including congruent grooves and ridges. The bottom portion of corner holder 20 has tabs 21 which in use are bent upwardly around the bottom of the rail 1 when it is slipped in place on the end of the rail. The top region of the corner holder 20 has a top ridge 22 which is carefully formed to fit snugly over the top ridge 7 of a rail 1, when it is slid in place in one end of the rail. Another rail 1, at right angles to the first rail, is slid into place in the right-angle portion of the corner holder 20, not taken up by the first rail thereby forming a firm corner joint.

Figure 8:
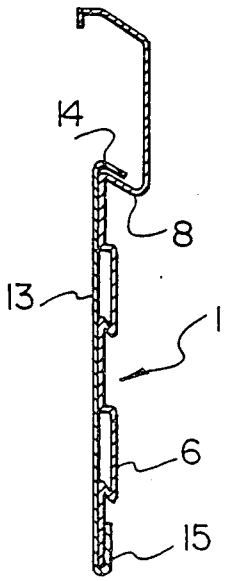
FIG. 8 represents an end view of a clip snapped in place on a siderail.
Figure 11:
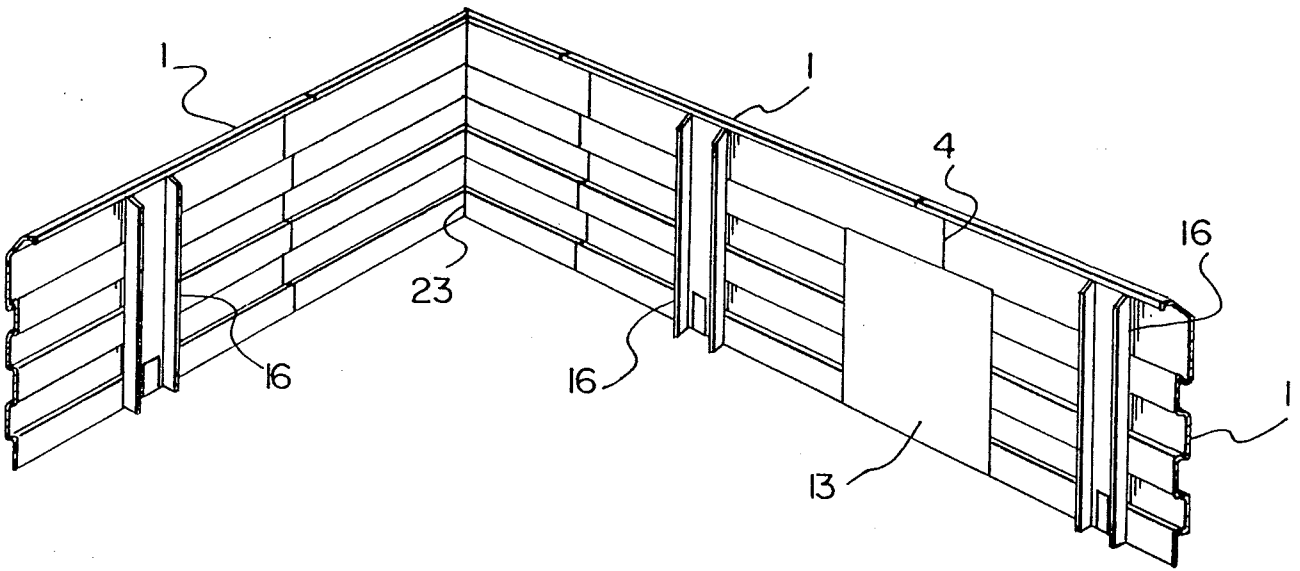
FIG. 11 represents a perspective view of an assembled concrete retaining system prior to concrete pour.

FIG. 11 illustrates the appearance of the concrete retaining rail system, from an internal perspective, when in place on the ground, prior to concrete pour. Two rails 1, which appear on the right side of FIG. 8, are held in end to end relation with one another at the seam 4 by a joining clip 13. The joining clip 13 is snapped in place so that a portion of it fits over each end of the two adjoining rails 1. The two rails 1 are secured to the ground by two stakes 16. The two stakes 16, at the top respective region of each, fit under lip 9, while the respective hook 17 and holder 18 portions of the two stakes snap over the top and bottom edges of the bottom groove of the rail 1. Thus, the rails 1 are secured firmly at both the top and bottom to the stake 16.

Arranged at right angles to the two rails 1 shown at the right side of the arrangement in FIG. 11 is a third rail 1. It is held in place by an outside corner holder 23. The outside corner 23 is formed in a similar manner to inner corner holder 20 (as discussed previously in association with FIG. 10) except that it is shaped to form an outside corner, rather than an inside corner. Corner holder 23 is formed to fit snugly about the end of a rail 1 when the rail 1 is slid into the appropriate grooves of the corner holder 23. In the arrangement shown in FIG. 11, concrete is poured within the boundaries formed by the adjoining rails 1, clips 13 stakes 16, and corner holder 23. Thus, when the concrete has been poured in place to the top of rails 1, it obscures from view all of the components that hold the side rails securely to the ground and to one another. The visible exterior of the rail assembly is clean and attractive.

When installing the applicant's system in place it is usual to first drive a series of stakes 16 into the ground at predetermined locations along a straight line. Rails 1 are then placed on the stakes 16 so that the bottom edges of the rails 1 fit into the bottom hooks 17 punched respectively in the stakes 16. The top regions of the stakes 16 fit behind lips 9 of the adjoining rails 1. Then, joining clips 13 are snapped in place to secure the ends of the adjoining rails 1 together. A corner holder 23 is then slid over the ends of the rails 1. At a right angle to the installed rails 1, an adjacent rail 1 is slid into the opposite side of the corner holder 23 opposite the side holding the first rail. A series of rails can then be installed in a linear row from the corner holder 23 and at right angles to the first row of rails 1.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

The embodiments of the invention in which an exclusive property or privilege is claimed are defined as follows:

1. A permanent, in-place, concrete retaining form comprising in combination:

(a) a longitudinal rail having along the length thereof, vertically disposed above one another, at least two alternating grooves and ridges, and at the top region thereof a top ridge which at the bottom edge thereof extends outwardly and downwardly to a location below the elevation where the top ridge meets the body of the rail, and at the top edge thereof terminates in a downwardly extending lip;

(b) a stake in the shape of a U-shaped channel, the top portion of the stake fitting under the top lip of the rail, the lower portion of the stake having therein a hook means for securing the bottom region of the rail to the stake; and, (c) a clip which is formed to fit snugly over the end of the rail.

2. A rail means according to claim 1 wherein a corner holder means shaped to fit snugly over the grooves and ridges at the end of a rail is fitted onto the end of the rail.

3. A system according to claim 1 wherein the rail means has two ridges therein, each having a downwardly extending overhang at the bottom edge of the ridge.

4. A form according to claim 1 where the rail means has three ridges therein, each having a downwardly extending overhang at the bottom edge of the ridge.

5. A form according to claim 3, wherein one of the ridges extends farther from the body of the rail means than the other ridge.

6. A form according to claim 1 wherein the rail means has a base portion which runs the length of the rail means parallel to the grooves and ridges, and extends downwardly from the point where the bottom ridge meets the body of the rail.

7. A form according to claim 2 wherein the corner holder has extending downwardly from the holder tabs which can be bent about the base of the rail to enhance the gripping action of the holder on the rail.

8. A form according to claim 1 wherein the clip fits about the bottom edge of the top region and about the bottom edge of the rail means.

9. A form according to claim 1 wherein the top region of the rail means extends outwardly from the rail means a distance which is farther than the extending distance of the ridge of the rails means.

10. A form according to claim 1 wherein the stake has a hook means which prevents the rail means from moving upwardly when the rail is staked to a stationary object.

* * * * *